US009771214B1

(12) United States Patent
Green et al.

(10) Patent No.: US 9,771,214 B1
(45) Date of Patent: Sep. 26, 2017

(54) TABLEWARE RETRIEVER APPARATUS

(71) Applicant: SpecSmart Foodservice Products, LLC, Cincinnati, OH (US)

(72) Inventors: Eric C. Green, Ft. Thomas, KY (US); Steven M. Brunner, Mt. Orab, OH (US)

(73) Assignee: SpecSmart Foodservice Products, LLC, Cincinnati, OH (US)

( * ) Notice: Subject to any disclaimer, the term of this patent is extended or adjusted under 35 U.S.C. 154(b) by 0 days.

(21) Appl. No.: 15/182,941

(22) Filed: Jun. 15, 2016

(51) Int. Cl.

| | |
|---|---|
| ***B03C 1/00*** | (2006.01) |
| ***B65F 1/00*** | (2006.01) |
| ***B65F 1/16*** | (2006.01) |
| ***B03C 1/26*** | (2006.01) |

(52) U.S. Cl.
CPC ..... *B65F 1/0033* (2013.01); *B03C 1/26* (2013.01); *B65F 1/1607* (2013.01); *B65F 2210/1525* (2013.01)

(58) Field of Classification Search
CPC ..... B65F 1/0033; B65F 1/1607; B03C 1/26
USPC ..... 209/214, 215, 219, 222, 223.1, 636
See application file for complete search history.

(56) References Cited

U.S. PATENT DOCUMENTS 3,333,692 A * 8/1967 Eveson ..... F26B 3/08 209/474
4,279,744 A * 7/1981 Antonwitsch ..... B03C 1/26 209/214
4,494,657 A * 1/1985 Oldenkamp ..... B03B 9/061 206/818
4,589,981 A * 5/1986 Barari ..... B03B 5/623 209/474
4,782,970 A * 11/1988 Edwards ..... B03C 1/26 209/215
5,797,497 A * 8/1998 Edwards ..... B07C 5/344 209/570
6,030,432 A * 2/2000 Kepplinger ..... C21B 13/0033 266/144
6,158,792 A * 12/2000 Snider ..... B03C 1/30 209/215
6,264,040 B1 * 7/2001 Mankosa ..... B03B 11/00 209/155
6,425,485 B1 * 7/2002 Mankosa ..... B03B 5/623 209/158
6,677,846 B2 * 1/2004 Snider ..... A47L 13/40 294/65.5

(Continued)

*Primary Examiner* — Terrell Matthews
(74) *Attorney, Agent, or Firm* — Jacox, Meckstroth & Jenkins

(57) ABSTRACT

Metal tableware articles are separated from trash as the trash is deposited into a trash container through a removable cover having brackets supporting a shaft of a magnetic bar assembly for rotation on a horizontal axis. The shaft is rotated from outside the cover by an axially movable rotatable pin having a knob on its outer end and extending through the side wall of the cover for releasably engaging one end of the shaft. When the knob and pin are retracted axially, the bar assembly may be lowered from the cover for cleaning. The bar assembly has axially spaced magnetic plate units each having a pair of generally triangular metal plates with flat corner surfaces and with a panel of magnetic material of the same shape sandwiched between the plates. The bar assembly is spaced above the bottom surface of the cover for protection of the bar assembly.

11 Claims, 2 Drawing Sheets

(56) References Cited

U.S. PATENT DOCUMENTS

| | | | | |
|---|---|---|---|---|
| 6,814,241 | B1 * | 11/2004 | Galvin | B01J 8/22 209/158 |
| 7,331,470 | B2 * | 2/2008 | Vernon | B03C 1/0332 209/213 |
| 9,415,397 | B1 * | 8/2016 | Christodoulou | B03B 5/623 |
| 2009/0223198 | A1 * | 9/2009 | Nye | H01F 7/04 56/400.11 |

* cited by examiner

TABLEWARE RETRIEVER APPARATUS

BACKGROUND OF THE INVENTION

This invention relates to apparatus for removing metal tableware articles from trash or garbage being deposited into a trash container, such as the apparatus disclosed in U.S. Pat. No. 4,279,744 and U.S. Pat. No. 4,494,657. The apparatus disclosed in these patents incorporates an elongated magnetic bar assembly having axially spaced magnetic elements and which may be supported within a lid or cover member for a trash container, as disclosed in the '657 Patent. The trash from a table is deposited into the waste container through an opening within the top of the lid or cover member so that the trash passes over the magnetic bar assembly where metal tableware, such as forks, knives and spoons, is held by the magnetic elements of the bar assembly and remain attached to the bar assembly until the lid is removed by a service person who manually separates the tableware from the bar assembly.

It has been found desirable to provide for rotating the bar assembly from outside the cover member without removing the cover member so that tableware articles may be conveniently removed from the magnetic bar assembly through the top opening of the cover member, including the articles that revolve by gravity to the bottom of the bar assembly. It has also been found desirable to provide for conveniently and quickly removing the magnetic bar assembly after the cover member has been removed from the trash container so that the bar assembly may be quickly washed, for example, in a dishwashing machine. It has also been found desirable to provide each of the magnetic units on the bar assembly with maximum magnetic strength for the size of the unit to decrease the possibility of tableware articles bypassing the magnetic bar assembly and falling into the trash container.

SUMMARY OF THE INVENTION

The present invention is directed to tableware retriever apparatus of the type described in the above mentioned patents and which provides the desirable features mentioned above. In the preferred embodiment of the invention, an elongated magnetic bar assembly is supported for rotation within a chamber of a cover member for a trash container and includes an elongated shaft supporting axially spaced magnetic plate units positioned above the bottom surface of the cover member. The magnetic bar assembly is rotatable by a knob located outside the cover member and releasably connected to an end portion of the shaft by a retractable support member. The opposite end portions of the shaft are supported by brackets attached to the inner surface of the cover member, and one bracket also supports the shaft support member and knob for rotation of the shaft of the magnetic bar assembly.

When the support member is retracted outwardly by the knob, the corresponding end portion of the shaft is released from the bracket so that the magnetic bar assembly may be quickly and conveniently lowered and removed from the chamber of the cover member for cleaning of the magnetic bar assembly and the cover member. Each of the magnetic plate units or plate assemblies has a panel of magnetic material sandwiched between two metal plates. The panel and metal plates are generally triangular in configuration with flat corner surfaces to provide maximum magnetic attraction and for the magnetic bar assembly to rotate in response to trash and tableware articles passing over the bar assembly by gravity as the trash material is deposited through the top opening within the cover member.

Other features and advantages of the invention will be apparent from the following description, the accompanying drawings and the appended claims.

DESCRIPTION OF THE PREFERRED EMBODIMENT

Figure 1:
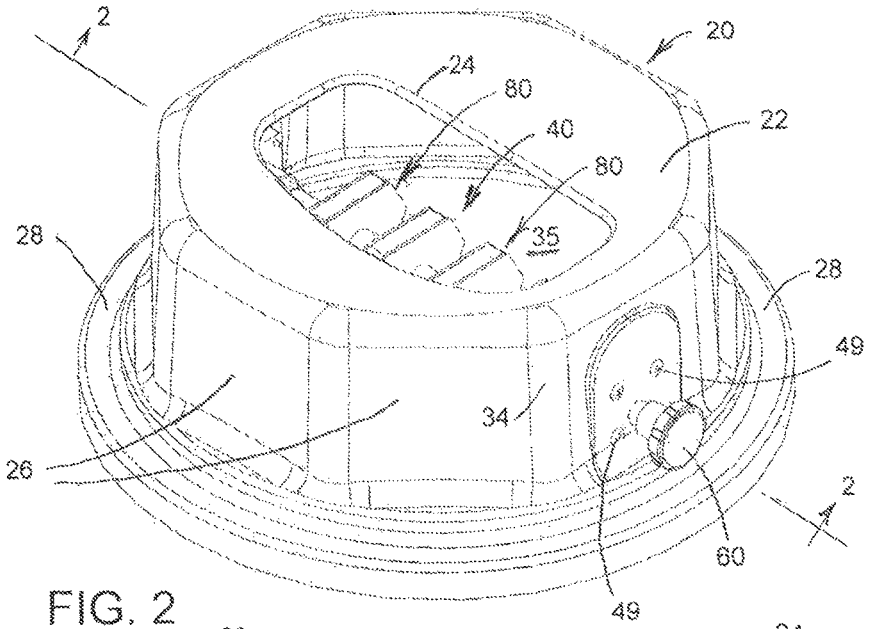
FIG. 1 is a perspective view of a trash container cover member constructed in accordance with the invention.

FIG. 1 illustrates a lid or cover member 20 for a conventional trash container (not shown) and which is molded of a plastics material such as an ABS plastic. The cover member has a slightly concaved top wall 22 with an elongated center opening 24 and is connected by a multi-faceted sidewall panels 26 to an outwardly projecting bottom peripheral flange portion 28 having a stepped cross-sectional configuration for receiving the rim portion of different diameter trash containers. Preferably, the cover member 20 has eight generally vertical side wall panels 26 connected by curved corner portions 34. The cover member 20 defines an interior chamber 35 which receives an elongated magnetic bar assembly 40 having an aluminum shaft 42. The shaft has a longitudinal flat surface 43 and opposite end portions rotatably supported by a set of brackets 44 and 46 molded of a plastics material and secured to the inner surfaces of opposing wall panels 26 by a set of blind rivets 49.

Figure 4:
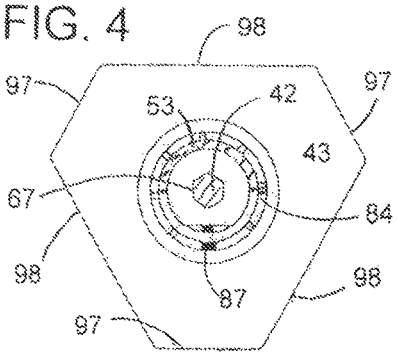
FIG. 4 is a vertical section taken generally on the line 4-4 of FIG. 2.
Figure 5:
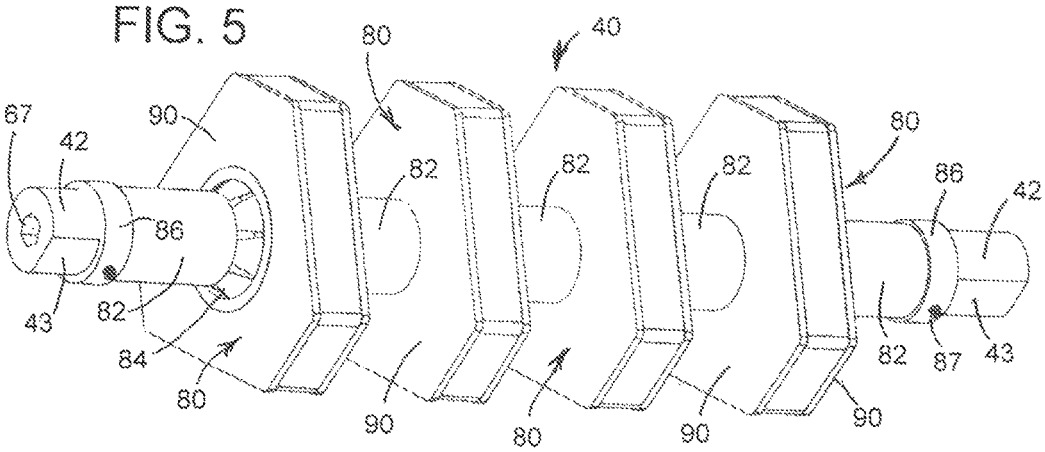
FIG. 5 is a perspective view of the magnetic bar assembly constructed in accordance with the invention and shown in section in FIG. 2.
Figure 6:
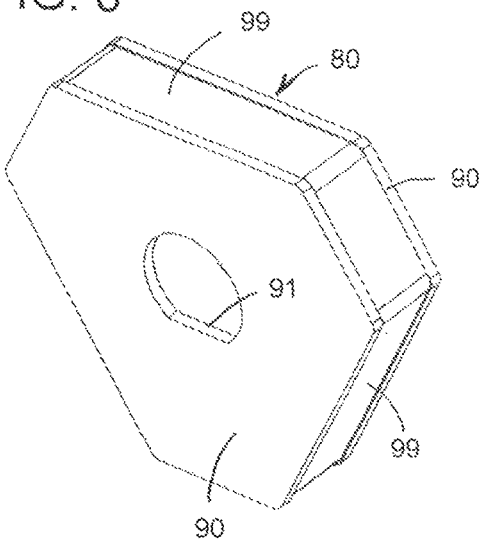
FIG. 6 is a perspective view of a magnetic plate assembly or unit shown in FIG. 5.
Figure 7:
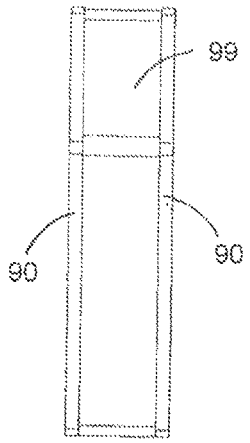
FIG. 7 is an edge elevational view of the magnetic plate assembly shown in FIG. 6.
Figure 8:
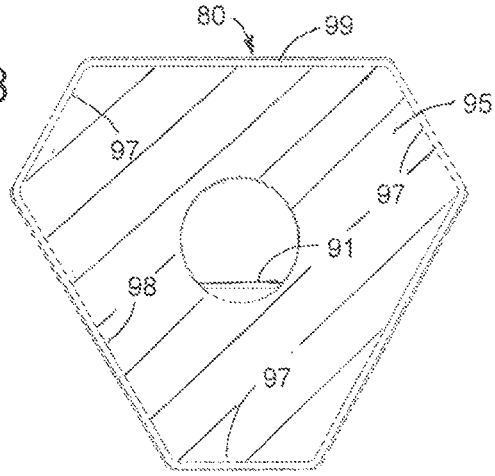
FIG. 8 is a vertical section of a magnetic plate unit or assembly, taken generally on the line 8-8 of FIG. 7.

The bracket 44 has a cylindrical bore 52 which supports one end portion of the shaft 42 of the bar assembly 40 for rotation, and the bracket 46 has as a semi-cylindrical bore 53 which helps locate and support the opposite end portion of the shaft 42 for rotation. The bracket 46 also has a center bore or hole 54 which supports a shaft support member or pin 57 for rotation and for axial movement. The member or pin 57 projects outwardly from the bracket 46 and cover member 20 and receives a knob 60 which is secured to the outer end portion of the pin 57 by a cross roll pin 62. The support pin 57 has a polyagonal or hexagonal inner end portion 64 (FIGS. 2 & 4) which projects into an end portion of a mating or hexagonal inner bore 67 of the shaft 42. The pin 57 cooperates with the part cylindrical bore 53 and cooperates with the bore 52 to support the shaft 42 for rotation of the magnetic bar assembly 40 by turning the knob 60.

The bracket 46 is molded with a blind cross hole or bore 69 which supports a lock pin 71 (FIG. 3) biased outwardly by a coil spring 72. The lock pin 71 has axially spaced cavities or recesses 74 and retains the support pin 57 in the position shown in FIG. 2 until the lock pin 71 is depressed against the spring 72 and the shaft support pin 57 is pulled outwardly by the knob 60 to remove the hexagonal end portion 64 of the support pin 57 from the hexagonal bore 67 within the shaft 42 to release the support of the corresponding end portion of the shaft 42.

Referring to FIGS. 2 & 4-8. the magnetic bar assembly 40 includes a plurality of magnetic plate units or assemblies 80 which are spaced on the shaft 42 by a series of plastic tubular spacers 82. The plate units 80 secured on the shaft by a pair of speed nuts 84 and with the end spacer sleeves 82 retained by a pair of lock collars 86 and set screws 87. Each of the magnetic plate units 80 include a pair of parallel spaced sheet metal plates 90 which have flat inner surfaces 91 for engaging the flat surface 43 on the shaft 42. Sandwiched therebetween the plates 90 is a panel 95 of magnetic material such as disclosed in the above '744 Patent. Both of the metal plates 90 and the core magnetic panel 95 have generally a triangular shape and substantially flat corner surfaces 97 with the longer flat surfaces 98 defining the triangle. A plastic or rubber protective strip or band 99 extends around each of the magnetic core panels 95 and between the edge portions of the metal plates 90.

Figure 2:
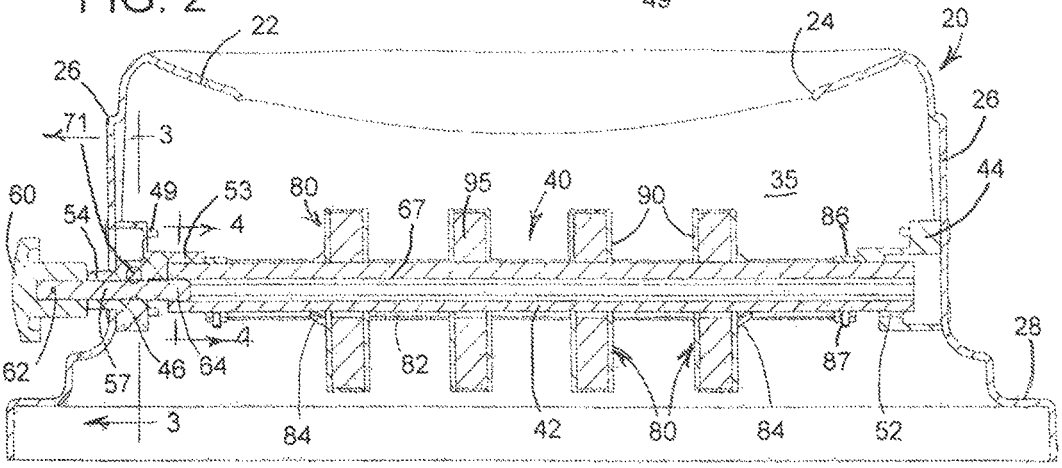
FIG. 2 is a vertical section take through the cover assembly and generally on the line 2-2 of FIG. 1.
Figure 3:
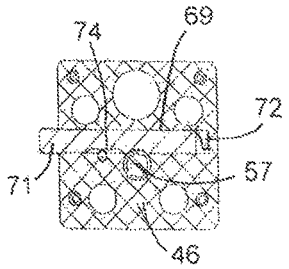
FIG. 3 is a vertical section taken on the line 3-3 of FIG. 2.

As apparent from FIG. 2, the magnetic bar assembly 40 may be rotated from outside the cover member 20 by turning the knob 60 to assure that the magnetic bar assembly 40 collects all of the metal tableware or silverware articles within the trash deposited into the cover member 20 through the top opening 24 and that the bar assembly may be conveniently rotated to remove the articles including the articles that revolve by gravity to the bottom of the bar assembly. After the magnetic bar assembly 40 has collected metal articles or requires cleaning, the cover member 20 may be removed from the trash container. The magnetic bar assembly and any collected metal tableware articles may then be easily and conveniently removed from the cover member by pushing inwardly on the lock pin 71 and pulling outwardly on the turning knob 60 to retract the end portion 64 of the pin from the end portion of the shaft 42. The bar assembly 40 may then be dropped downwardly or lowered and removed from the cover member to facilitate removal of any metal tableware articles and for cleaning of the magnetic bar assembly 40 under a faucet or in a dishwashing machine.

After the bar assembly 40 is cleaned, it may be quickly and easily reinserted into the cover member 20 by pressing the knob 60 and support pin 57 inwardly until the hex end portion 64 is reinserted into the hex bore 67 of the shaft 42. After the rotating support pin 57 is reinserted into the end portion of the shaft 42 by use of the knob 60, the cover member 20 is placed back on the trash container and the magnetic bar assembly 40 is ready for reuse for collecting the metal tableware articles. As apparent in FIG. 2, all of the magnetic plate assemblies or units 80 remain above the bottom surface of the cover member 20 so that the magnetic bar assembly 40 and all of the magnetic plate units 80 are protected in the event the cover member 20 is inadvertently dropped after it is removed from the trash container.

While the form of tableware retriever apparatus herein described constitutes a preferred embodiment of the invention, it is to be understood that the invention is not limited to this precise form of apparatus, and that changes may be made therein without departing from the scope of the invention as defined in the appended claims.

What is claimed is:

1. Tableware retriever apparatus for separating metal tableware articles from trash deposited into a trash container through a top opening of a removable cover member having a side wall defining a chamber, the apparatus comprising an elongated magnetic bar assembly enclosed within the chamber of the cover member and including an elongated shaft having an axis and opposite end portions, a plurality of magnetic plate units mounted on the shaft in axially spaced relation with each of the magnetic plate units including a set of parallel spaced non-circular metal plates separated by a magnetic material, a manually rotatable member having a gripping portion outside the cover member and an inner portion projecting through a side wall of the cover member, a releasable coupling connecting the inner portion of the rotatable member to one end portion of the shaft and providing for conveniently rotating the bar assembly from outside the cover member to cause trash to fall into the trash container and to expose tableware articles for removal through the top opening, and the releasable coupling further providing for conveniently removing the bar assembly from the cover member to facilitate cleaning of the bar assembly.

2. Apparatus as defined in claim 1 wherein each of the metal plates of each magnetic plate unit is generally triangular in configuration with substantially flat corner surfaces.

3. Apparatus as defined in claim 1 wherein the releasable coupling connects one end portion of the shaft to the inner portion of the manually rotatable member in interfitting relation and provides for rotating the bar assembly in response to rotation of the rotatable member.

4. Apparatus as defined in claim 1 wherein the cover member has a bottom surface defining a bottom opening for receiving the trash container, the bar assembly is supported within the chamber for rotation with the plate units above the bottom surface of the cover member, and the releasable coupling provides for releasing an end portion of the magnetic bar assembly for removing the bar assembly through the bottom opening.

5. Apparatus as defined in claim 1 wherein the cover member has a multi-faceted outer surface formed by generally vertical and substantially flat side wall panels.

6. Apparatus as defined in claim 1 wherein the opposite end portions of the shaft of the magnetic bar assembly are supported by brackets attached to opposing inner surface portions of the cover member, and one of the brackets provides for releasing the support of the corresponding end portion of the shaft in response to axial movement of the inner portion of the rotatable member within the one bracket.

7. Apparatus as defined in claim 6 wherein the one bracket supports a spring biased locking pin for the rotatable member, and the one bracket has a recess for releasing the rotatable member for axial movement to release the support of the corresponding end portion of the shaft.

8. Apparatus as defined in claim 1 wherein the elongated shaft of the magnetic bar assembly is tubular with a longitudinally extending hexagonal inner surface and a longitudinally extending flat outer surface.

9. Apparatus as defined in claim 1 wherein the magnetic material of each magnetic plate unit comprises a flat panel having substantially the same size and shape as the corresponding metal plates.

10. Apparatus as defined in claim 1 wherein the elongated shaft of the magnetic bar assembly is tubular with a longitudinally extending polyagonal inner surface, and the inner portion of the support member has a polyagonal end portion releasably engaging the inner surface of the shaft.

11. Apparatus as defined in claim 1 wherein the gripping portion of the rotatable member comprises a knob substantially larger then the shaft.

* * * * *